United States Patent [19]

Skarivoda

[11] Patent Number: 4,853,558

[45] Date of Patent: Aug. 1, 1989

[54] PROGRAMMABLE TIMER WITH SKIP CYCLE

[75] Inventor: Edwin L. Skarivoda, Manitowoc, Wis.

[73] Assignee: Paragon Electric Company, Inc., Two Rivers, Wis.

[21] Appl. No.: 154,841

[22] Filed: Feb. 10, 1988

[51] Int. Cl.[4] ..... H01H 7/08

[52] U.S. Cl. ..... 307/141; 206/38 DA; 206/38 DB

[58] Field of Search ..... 206/38 D, 38 DA, 38 DB, 206/38 DC, 38 DD, 38 AA, 38 BA; 307/141.1

[56] References Cited

U.S. PATENT DOCUMENTS

| | | | |
|---|---|---|---|
| 2,300,513 | 11/1942 | Lenehan | 200/38 DB |
| 2,688,366 | 9/1954 | Morrison | 200/38 DA |
| 3,033,950 | 5/1962 | Flegal | 200/38 DA |
| 3,573,403 | 4/1971 | Poschman et al. | 200/38 DB |
| 4,061,893 | 12/1977 | Sanner | 200/38 D |

*Primary Examiner*—Bernard Roskoski

*Attorney, Agent, or Firm*—Foley & Lardner

[57] ABSTRACT

A timer device has the ability to be programmed to skip specified time intervals where it is desired that the operative sequence initiated at predetermined times be avoided. The device has moveable timing elements which can be inserted at selected locations on a rotating timing dial to determine the start, termination and duration of an operative sequence. Additional moveable elements on an associated slip wheel can be inserted at selected locations to determine a time interval during which the operative sequence can be avoided.

20 Claims, 4 Drawing Sheets

PROGRAMMABLE TIMER WITH SKIP CYCLE

BACKGROUND OF THE INVENTION

The present invention relates to programmable timers. Timers including a rotating dial which can be manually programmed for specified timer intervals during a 24-hour period are, in general, known. An example is described in U.S. Pat. No. 3,588,396 issued on June 28, 1971 to G. D. Fredell. As described therein, a cylindrical drum is provided with a plurality of spaced channels into which pins can be inserted. Rotation of the drum causes the pins to sequentially engage a mechanism to controllably open and close an electrical switch.

Timers capable of initiating certain events at predetermined times during a day for predetermined intervals on selected days of a week are also known. For example, U.S. Pat. No. 3,864,539 issued on Feb. 4, 1973, to Hansen describes a timer including respective rotating drums or dials corresponding to the time of day and the days of the week. Switch elements mounted on each dial can be moved between engaging and disengaging positions. When in the engaging positions, the switch elements engage microswitches and a controlled device is activated. The controlled device is not activated for any day, however, in which the respective switch element is in its disengaging position. Timing devices of this type permit selection of days in which the controlled device is not activated. Such devices tend to be overly complex, often employing numerous switches to mechanically accomplish the programming of the device, and offer less reliability.

SUMMARY OF THE INVENTION

The programmable timer device in accordance with a preferred embodiment of the present invention has a lightweight, simple to operate rotable timer with a plurality of locations adapted to receive removable timing elements which when in position on the dial, define a timer interval within a certain time cycle such as a 24-hour period in which the electrical state of a remote controlled apparatus may be changed. The timer also includes a switch mechanism which, responding to movement of the timing elements and depending upon a predetermined sequence of operation, opens or closes certain electrical switch elements connected to the remote controlled apparatus. The rotatable timer and associated removable timer elements can be programmed as desired to render the switch mechanism non-responsive to the movement of the timing elements during a preselected time cycle or cycles. A skip cycle mechanism also responsible to the location of certain of the removable timing elements can be programmed to render the switch mechanism inactive during one or more time periods thereby precluding any changes of electrical state of the remote apparatus.

BRIEF DESCRIPTION OF THE DRAWING

A preferred exemplary embodiment of the present invention will hereinafter be described wherein like numerals denote like elements and.

DETAILED DESCRIPTION OF THE PREFERRED EMBODIMENT

Figure 1:
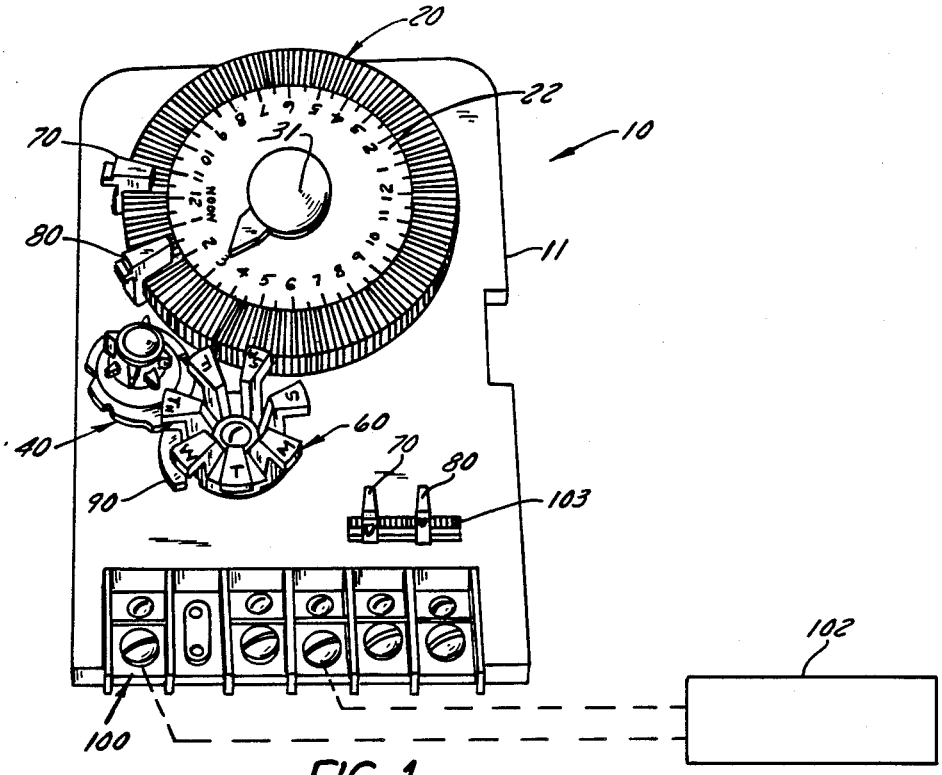
FIG. 1 is a perspective top view of a programmable timer device made in accordance with the present invention depicting the spatial relationship of the timer dial, activator wheel, skip cycle wheel and movable elements.
Figure 2:
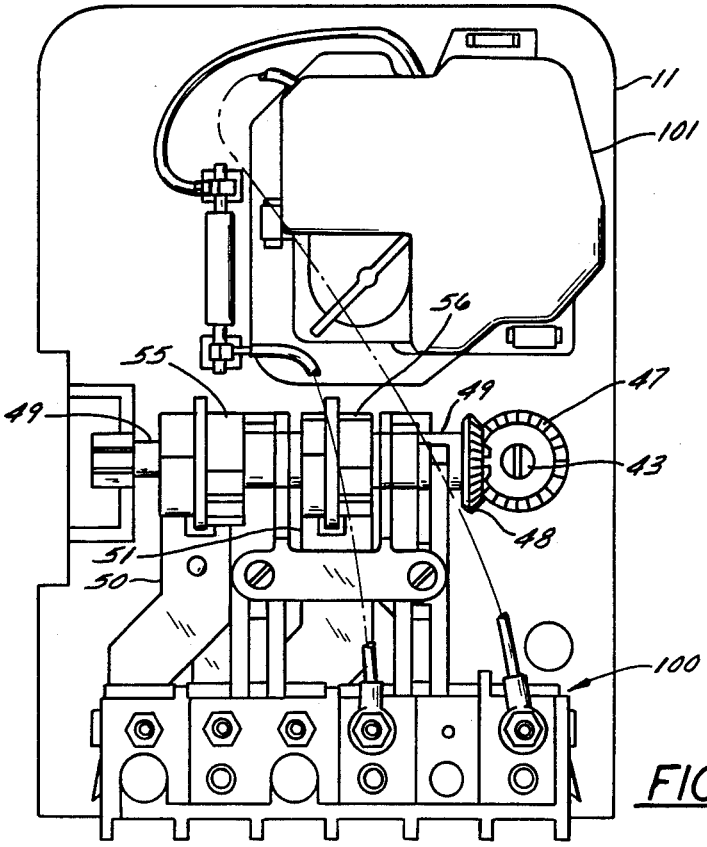
FIG. 2 is a elevation view of the reverse side of the device show he electrical components and a remote apparatus controlled by the device.

The programmable timer device in accordance with the present invention is indicated generally as reference numeral 10 in FIG. 1. Device 10 comprises a frame 11 supporting, in a spaced-apart relationship, a timer dial 20, an activator wheel 40 and skip cycle wheel 60,, and on the reverse side, as shown in FIG. 2, a plurality of electrical components, generally terminal blocks 100 and a motor housing 101. Terminal block 100 is electrically connected to a remote apparatus 102.

Referring to FIGS. 1 and 3–6, timing dial 20 is mounted for rotational movement on frame 11 and is operatively connected to a motor within motor housing 101 in a conventional manner through pinion gear 101*a*. For the sake of clarity, the motor and linkages to dial 20 are not shown. Dial 20 suitably a lightweight, generally hollow member made of plastic by an injection molding process. A dial 20, essentially circular in top elevation view, includes a top 22, integrally connected with a downwardly-extending annular flange 23 which fits over boss 11*a* extending up from frame 11. Boss 11*a* defines a central bore which receives snap fastener pin 24*a* securing dial 20 to frame 11. A second annular flange 25 extends downward from the outer periphery of top 22 and provides, among other functions, a meshing gear surface for pinion 101*a*. A multiplicity of flat, vertically-oriented ribs 26 project outwardly on radial lines emanating from the center of dial 20 and divide the circle of dial 20 into discrete equal arcs. The terminal ends of ribs 26 define a circle concentric with dial 20.

A reinforcing support member 27 spans the arcuate space between each rib 26. A horizontally oriented arm 28 is positioned intermediate the top and bottom edges of ribs 26 and extends outward from flange 25. Arm 28 terminates in a vertically-oriented member 29 which extends toward, but does not reach, top edge of ribs 26.

Collectively, the top surface 29a of members 29 define a rim (when viewed in the top elevation of FIG. 5) concentric with dial 20 and positioned inside the circle defined by the outer edges of ribs 26. Each pair of adjacent ribs 26, along with support member 27 extending between the pair of adjacent ribs 26, defines a slot 30 for purposes to be described hereinafter.

Figure 4:
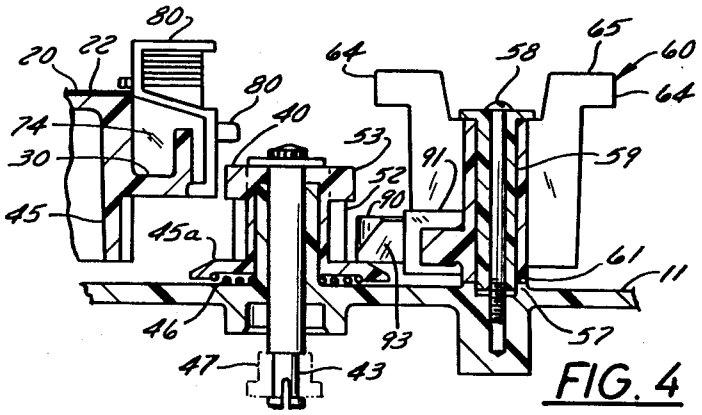
FIG. 4 is a side sectional view of a portion of the device illustrating the depression of the activator wheel by the skip wheel.
Figure 5:
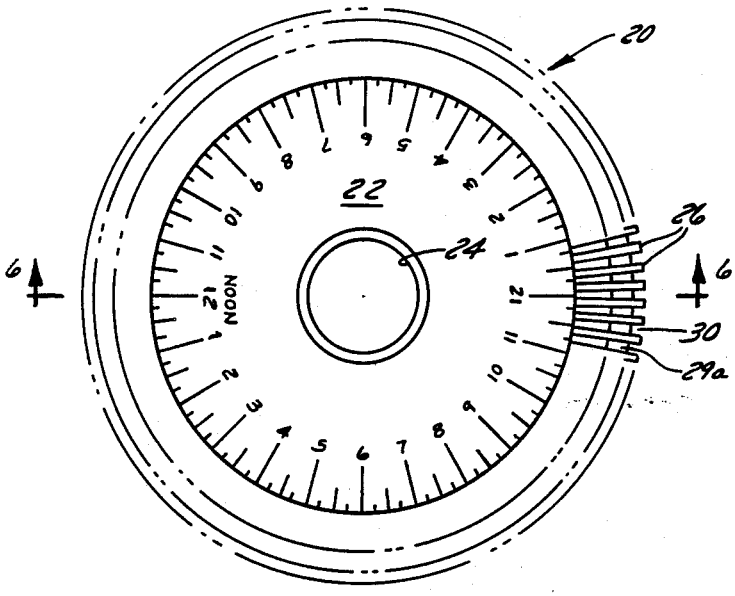
FIG. 5 is a top elevation view of the timer dial.

Indicia of a particular time cycle may be enscribed directly on the surface of top 22, or a replacement circular thin mat 22a such as seen in FIG. 4. The time cycle may be for example a twenty-four-hour day divided into fifteen minute periods. The fifteen-minute intervals coincide with the discrete arcs between adjacent ribs 26. As shown in FIG. 1, a stationary dial pointer 31, pointing at the center of adjacent activator wheel 40, is mounted in the center of dial 20. Pointer 31 indicates the current cycle time.

Referring now to FIGS. 3 and 7–9, actuating wheel 40 has a central bore 42 adapted to receive a boss 42a extending up from 11. Bore 42 manifests a non-circular configuration along at the upper portion of its length to key to a complementary configuration of shaft 43, in order to transfer its rotational movement thereto but permit relative axial translation between wheel 40 and shaft 43. Skirt 44 forms the lower portion to wheel 40 and has an outer periphery 45 spaced above the surface of frame 11. Wheel 40 and its various component parts are preferably made of light plastic materials formed in a conventional manner through an injection molding process. A helical spring 46 mounted about boss 42a maintains wheel 40 at a specified position along shaft 43, i.e., a position in which skirt 44 is displaced a predetermined distance above the surface of frame 11. Wheel 40 thus may be moved along shaft 43 against the bias of spring 46 under an appropriate force as described hereinafter.

Figure 7:
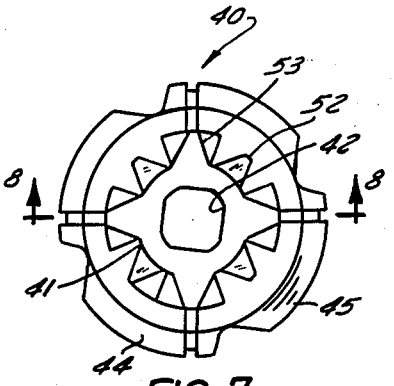
FIG. 7 is a top elevation view of the activator wheel activator
Figure 8:
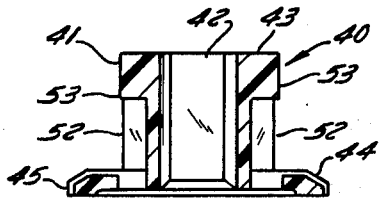
FIG. 8 side section view of the activator wheel of FIG. 5 taken along lines 8—8.
Figure 13:
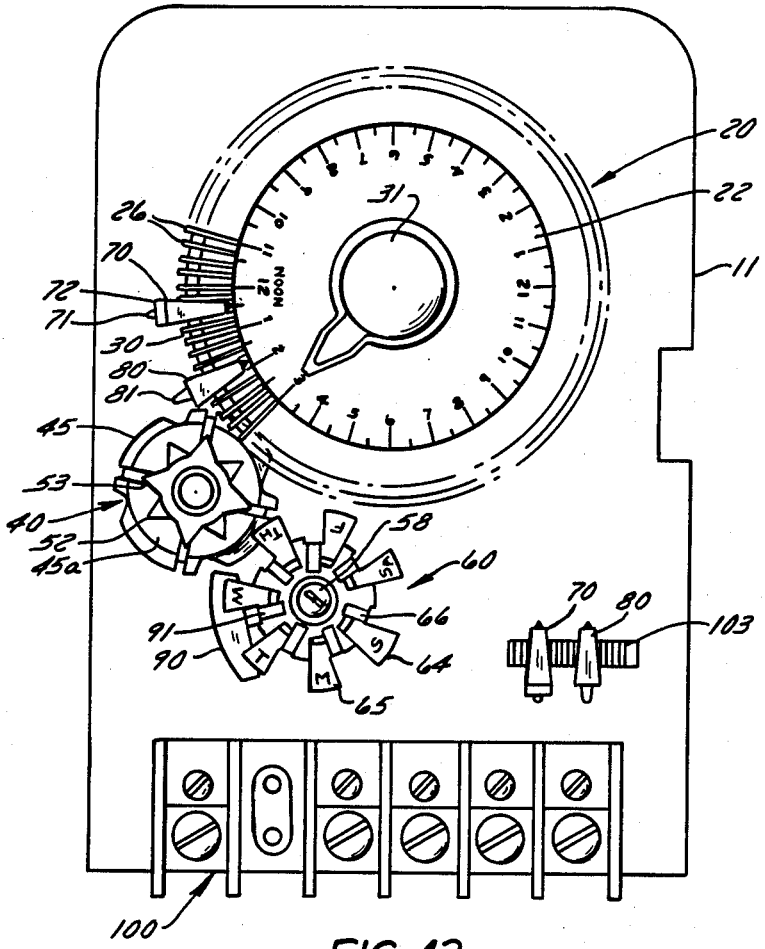
FIG. 13 is a top elevation view of the programmable timing device showing the overlapping relationship of the dial, activator wheel and skip wheel.

As best seen in FIGS. 1 and 7, wheel 40 is additionally provided with two arrays of four wedge-shaped fingers 52 and 53 which are suitably positioned 90° from each other. As illustrated, fingers 53 are elevated above fingers 52 and are off set 45% relative thereto. When wheel 40 is rotated, fingers 52 and 53 pass close to, but do not engage, the outer edges of ribs 30 of dial 20 while the outer periphery of skirt 44 passes close to, but does not touch, skip wheel 60 as perhaps best seen in the plan view of FIG. 13.

Referring now to FIG. 2, which illustrates the reverse side of frame ll, shaft 43 is keyed to a pinion gear 47 which meshes with a gear 48 mounted on a shaft 49 rotatably secured to frame 11. Two sets of cams 55 and 56 are secured to shaft 49. Mounted to frame 11 are a pair of switches with blades 50, 51 in contact proximity with the surfaces of cams 55, 56. The configuration of the cam surfaces are dimensioned to open and close switch blades 50 and 51 when shaft 49 turns a predetermined angle such as, for example, 45° . Other and different types of cams and switches may be employed in accordance with the application in which the timer device 10 is to be used.

Figure 3:
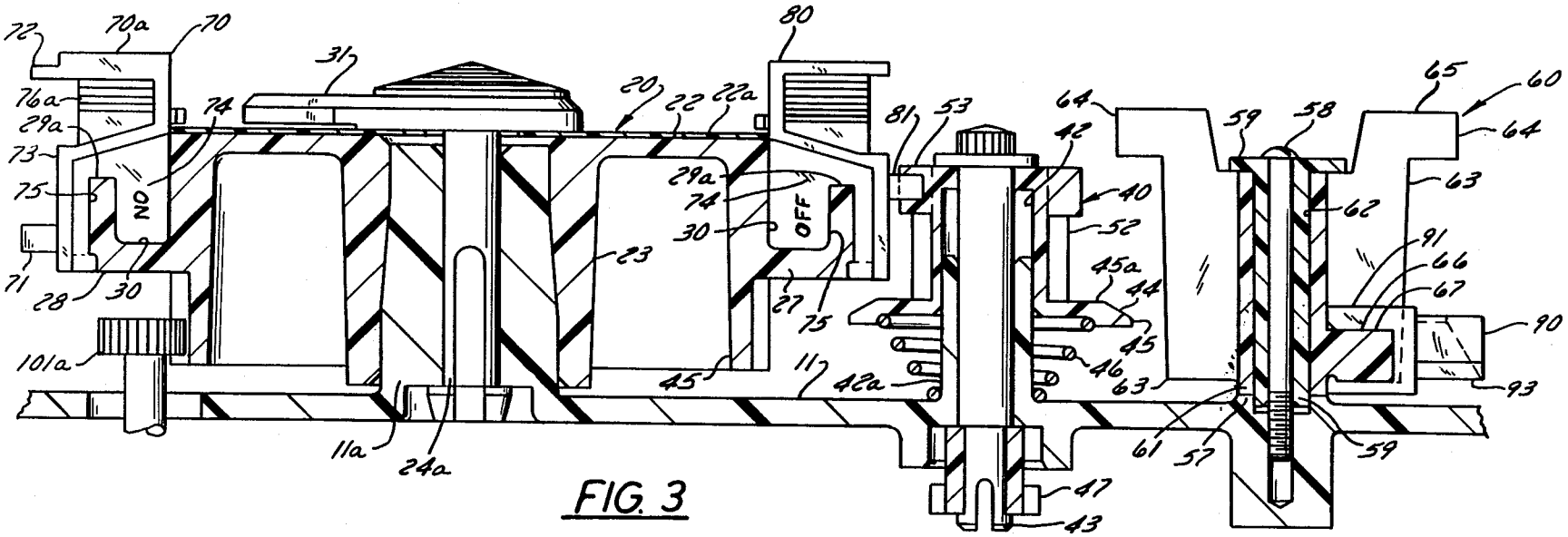
FIG. 3 is a side sectional view of the device illustrating the cooperative relationship among the timer dial, activator where and skip wheel.
Figure 10:
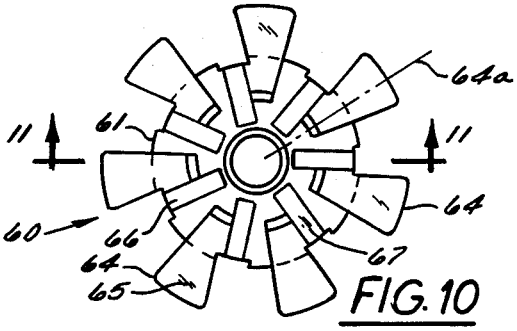
FIG. 10 top elevation view of the skip cycle
Figure 11:
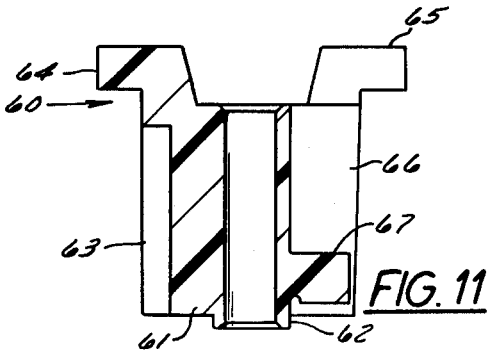
FIG. 11 is a side sectional view of the wheel in FIG. 8 taken along lines 11—11.
Figure 12:
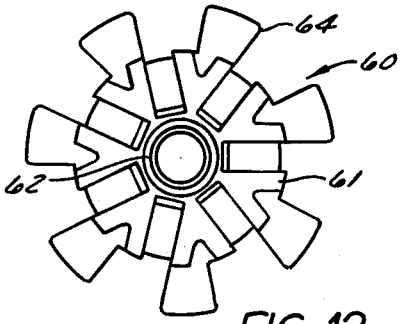
FIG. 12 is a bottom view of the skip cycle wheel.

In FIG. 3, it may be seen that skip wheel 60 is positioned on boss 57 of frame 11 via bolt 58 extending through a cylindrical bearing member 59 positioned within boss 57. Wheel 60 itself comprises a generally cylindrical base 61, a vertical base 62, and a plurality of arms 63 extending vertically upward from base 61 and terminating in lobes 64. Proximate to the juncture of each arm 63 with base 61 is a slot 66 defined by top surface 67 of base 61 and arm 63. Lobes 64 have a truncated triangular configuration when viewed in top elevation (FIG. 10), with a radial center line 64a emanating from the vertical axis of base 61. The top surface 65 of each lobe 64 is generally parallel to the top plane of frame 11. The design of lobes 64 desirably provides an area for indicia on top surface 65 (as discussed below). This design, however, is not an essential feature, and other and different configurations could be employed to carry out the required function. Thus, wheel 60 is secured for rotational movement relative to frame 11 whereupon lobes 64 pass close to, but do not touch, the upper edges of ribs 30 of dial 20.

Figure 14:
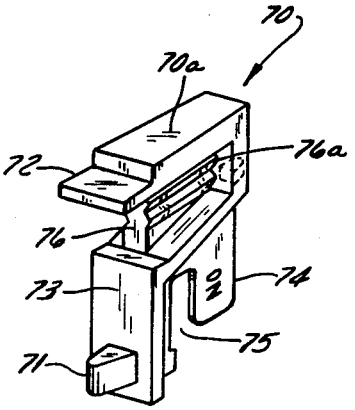
FIG. 14 is a perspective of a first movable element associated with the timer dial.

Removable "on" and "off" elements are selectively disposed in slots 30 of dial 20 to selectively index wheels 40 and 60 in accordance with rotation of dial 20. The structure of movable "on" element 70 is best seen in FIG. 14. The head of element 70 includes a horizontal surface 70a, a shank 76, a downwardly-extending front flange 73 and respective extensions 71 and 72 projecting outwardly from flange 73. Integral to flange 73 is a fin-shaped positioning peg 74, which fits within the narrow confines of slots 30 of dial 20. A cutout portion 75 allows peg 74 to fit over member 29 of dial 20. The snug fit of peg 74 between adjacent ribs 26 and the cooperation between cut-out portion 75 and member 29 immobilizes element 70 within any of slots 30. The shank portion 76 provides a gripping surface 76a to facilitate quick removal or relocation thereof.

When in position on dial 20, flange 73 covers the outer edges of the ribs 26 upon which element 70 is positioned. Extension 72 is disposed to interact with lobes 64 cf skip wheel 60. As dial 20 carries element 70 into a point of conjunction (i.e., a point existing on the line ("line of conjunction") connecting the centers of rotation) between dial 20 and skip wheel 60, tip of extension 72 contacts a lobe 64 and indexes wheel 60 a portion of one revolution thereof.

Similarly, extension 71 projects outwardly a sufficient distance to contact a finger 52 of wheel 40 when element 70 is carried into the point of conjunction between dial 20 and wheel 40, causing wheel 40 to be indexed a portion of one revolution thereof. Referring to FIG. 3 once again, it should be noted when an element is placed on dial 20, that extension 72 is positioned high enough on flange 73 to avoid contact with either a finger 52 or 53.

Figure 15:
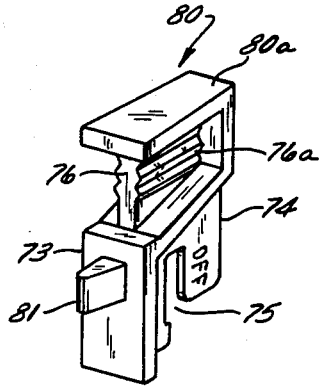
FIG. 15 is a perspective view of a second movable element associated with the timer dial.
Figure 16:
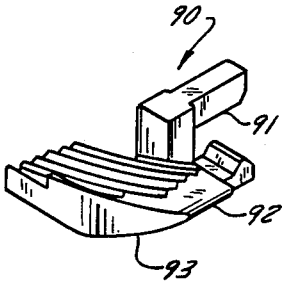
FIG. 16 is a perspective view of third movable element associated with the skip wheel.

The structure of "off" element 80 illustrated in FIG. 15 is very similar to element 70 and like character numerals are used to denote identical structure. However, "off" element 80 includes a single extension 81, which is positioned to interact with a finger 53 rather than a finger 52 when element 80 is carried to the point of conjunction between dial 20 and wheel 40.

Figure 6:
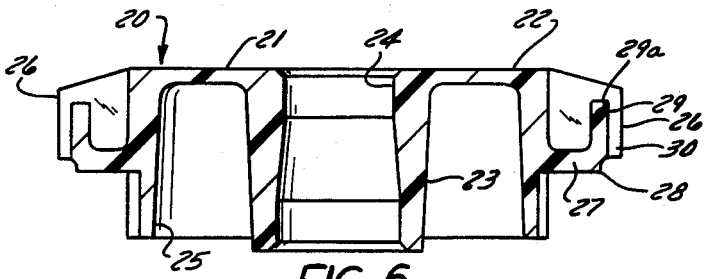
FIG. 6 is a side section view of the dial of FIG. 3 taken along lines 6—6.
Figure 9:
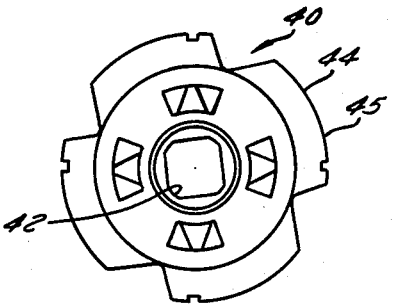
FIG. 9 view of the activator wheel.

A third movable element 90 (sometimes referred to as "skip" element 90) is associated with skip wheel 60. As seen in FIG. 6 element 90 has a peg shaft 91, which fits within one of s 66 and terminates at the other end as a cam element 92 having a cam surface 93. Surface 93 is dimensioned so that it can ride onto the top surface 45 of skirt 44 of actuating wheel 40 when element 90 is carried by skip wheel 60 to the point of conjunction between wheels 40 and 60 as depicted in FIG. 4. Element 90 thus depresses wheel 40 against the bias of spring 46 into a new axial position, in which position neither extension 71 or 81 can contact fingers 52 or 53.

Operation

As used in this description, "changing of electrical state" includes, for example, energizing or de-energizing remote device 102 or any alteration in the performance thereof due to selective changes in supplied power. Timer device 10 may operate over a designated number of cycles. For example, a week may be called a "cycle period" and each day a "operating cycle," "unit cycle," or "cycle". During each operating cycle of the cycle period, timer device 10 may be programmed as desired to change the electrical state of the remote device one or more times. The predetermined sequence of changes of electrical state within a cycle is called the "operative sequence" of the timer for purposes of this description. As will be apparent from a reading of the portion of description devoted to the operation, timer device 10 is capable of being programmed to provide a repetition of the predetermined operative sequence during successive cycles for the entire cycle period and omitting one or more operative sequences, i.e., the skipping of a sequence or sequences, in one or more predetermined cycles in any order desired.

The following operative sequence of timer 10 is described using a twenty-four-hour day as the operating cycle and a week as the cycle period. As shown in FIG. 1, an "on" element 70 is positioned in a slot adjacent indicia representing 11:15 a.m. and "off" element 80 adjacent indicia representing 1:30 p.m. A skip element 90 is positioned in a slot 66 adjacent to arm 63 by lobe 64 bearing indicia for Wednesday. Thus, the timer device 10 is now programmed such that the operative sequence will be initiated at 11:15 a.m. and terminated at 1:30 p.m. and the entire sequence is skipped on the Wednesday cycle.

Driven by motor 101 and associated pinion gear **101*a*, dial 20 continues to rotate in a clockwise direction. When "on" element 70 is moved into a position near the point of conjunction between wheels 20 and 60, extension 72 interacts with a lobe 64 similarly positioned near such point, indexing wheel 60 one-seventh of a revolution and bringing the next lobe 64 into position to be contacted. For example, an adjacent lobe 64 may correspond to Sunday, while the next lobe 64 corresponds to Monday, and so on. When element 70 aligns with pointer 31, i.e., reaches the point of conjunction of dial 20 and wheel 40, extension 71 contacts an adjacent finger 52 of wheel 40 and indexes wheel 40 through an arc of 45°, bringing a finger 53 adjacent dial 20. Through the various connections, i.e., gears 47, 48 and shafts 43, 49, the cams 55, 56 rotate, causing blades 50, 51 to close a circuit, thus activating remote device 102**.

When element 80 reaches the conjunction point, extension 81 contacts an adjacent finger 53 and indexes wheel 40 another 45°, causing cams 55 and 56 to rotate and open the circuit, and de-activating remote device 102. At the same time, finger 52 is moved near the line of conjunction. The de-activated state continues until the next successive element 70 and extension 71 again rotates wheel 40.

The interaction of extensions 71 and 81 with fingers 52 and 53 is, however, inhibited during unit cycles corresponding to the placement of "skip" element 90. For example, to "skip" activation of remote device 102 on "Wednesday" a skip element 90 is inserted in the slot 66 associated with lobe 64 corresponding to Wednesday (marked W). As wheel 60 is indexed to bring the lobe 64 corresponding to Wednesday into conjunction with wheel 40, cam surface 93 of element 90 cams against the top surface 45 of skirt 44 of wheel 40, moving skirt 44 and wheel 40 downwardly against the upward bias of spring 46. The depressed position is maintained until wheel 60 is again indexed, to remove cam surface 93 from skirt 44.

The axial translation of wheel 40, caused by the camming action of skip element 90, is sufficient to allow extensions 71 and 81 to move over the adjacent fingers 52 and 53 perhaps best illustrated by FIG. 3. Consequently, wheel 40 is not indexed and the remote device not activated during the cycle representing Wednesday. Since wheel 40 is not indexed, the next finger 53 remains in its position. Thus, in this example, the controlled device continues in a de-activated state for the entire cycle, until wheel 60 is again indexed, removing cam surface 93 from its abutting relationship with skirt 44 and allowing wheel 40 to return to its original position. Once wheel 40 is released, the programmed operative sequence is again initiated when element 70 again reaches the line of conjunction between dial 20 and wheel 40.

From the foregoing operative discussion, it is easy to understand how the timing device may be advantageously employed in many applications where it is desirable not to utilize an operative sequence during a predetermined time cycle.

The device may also be adapted to the skipping of multiple cycles during a cycle period and/or the programming of more complex operative sequences during a single cycle. This is accomplished by the appropriate positioning of a plurality of movable elements 90 on skip wheel 60. Additionally, through the use of additional sets of "on" elements (similar to element 70 but with extension 72 removed) and "off" elements 80, multiple operative sequences can be established within a single cycle. To accomplish this, an "on" element 70 (with extension 72) and "off" element 80 are positioned on dial 20 corresponding to the earliest actuation period to index wheel 60. Sets of modified "on" elements 70 (lacking extension 72) and "off" elements 80 are disposed at successive positions on dial 20 to index wheel 40. Thus, multiple operative sequences can be effected during a single cycle.

To facilitate rapid identification of elements 70, 80 and 90 and modified elements 70, each element may be color-coded. For example, element 70 may be yellow, while element 80 may be coded red. Additionally, frame 11 may be provided with a plurality of slots 103 in which extra elements may be secured when not being used.

It will be understood that the foregoing description is of a preferred exemplary embodiment of the present invention and that the invention is not limited to the specific forms shown. Modifications may be made in design and arrangement thereof within the scope of the present invention, as expressed in the appended claims.

I claim:

1. A programmable timer device for the selective change of electrical state of a remote apparatus during a time cycle comprising:

(a) moving programmable cycle means for determining a cycle of operation of said timer device;

(b) selectively movable operative sequence means positioned at preselected positions on said cycle means for establishing an operative sequence within said cycle of operation;

(c) activator means, including a rotatable member moveable substantially along the axis of rotation between first and second axial positions, for changing the electrical state of said remote device in response to the movement of said cycle means when said rotatable member is in said first axial position; said activator means being in operative contact with said sequence means when said rotatable member is in said first axial position; and (d) skip cycle means, being sequentially contacted by said sequence means when said skip cycle means and said sequence means are in a predetermined alignment, for moving said rotatable member to said second axial position, said activator means being out of operative contact with said sequence means when said rotatable member is in said second axial position whereby said remote apparatus remains in the same electrical state during a next operating cycle.

2. The device of claim 1 in which said cycle means comprises a rotating dial and means for rotating said sequence means comprises selectively movable first and second elements positioned in predetermined locations around the outer periphery of said dial.

3. The device of claim 2 in which said movable first and second elements have first and second extensions, respectively, and said activator means contacts said first and second extensions when said extensions are carried by said dial to a point adjacent said activator means.

4. The device of claim 2 in which said rotatable member comprise a rotatable wheel positioned adjacent said dial and having first and second projection means, said first and second projection means indexing said rotatable wheel in response to respective contact with said first and second extensions.

5. The device of claim 4 in which said rotatable wheel is in operative contact with a plurality of switches adapted to be electrically connected to said remote-controlled device.

6. The device of claim 4 in which said first projection means is a first array of radial projections positioned around said wheel and said second projection means is a second array of radial projections positioned around said wheel, said second array positioned axially above said first array.

7. The device of claim 6 in which said first extension is positioned vertically lower than said second extension.

8. The device of claim 7 in which said first array of projections are angularly offset from said second array of projections.

9. The device of claim 7 in which each array contains four projections positioned 90° apart and each of said projections of first array is oriented to point at an angle of 45° with respect to said second array of projections.

10. The timing device of claim 7 in which said skip cycle means is a rotatable member positioned adjacent to said dial and said wheel has a plurality of arms extending out from the center of said member, said rotatable member being indexed as each of said arms is sequentially contacted by said sequential means when said dial is rotated to a predetermined relationship with respect to said rotatable member.

11. The timing device of claim 10 in which said skip cycle means includes a selectively movable actuating contact element positioned on said rotatable members, said contact element contacting said wheel when said dial and rotatable member are in said predetermined relationship.

12. The device of claim 11 in which said activator wheel is biasedly held in said first position for contact between said extension and projections and moves to said second position in response to contact with said contact element in which said projections are displaced from contact with said extensions, said activator wheel returning to said first position when said rotatable member is next indexed.

13. The device of claim 12 in which said contact means comprises a cam surface and said actuator wheel has a cam bearing surface.

14. The device of claim 10 in which said first element has a tab positioned above said first extension, said tab contacting one of said arms of said member when said dial and said member are in said predetermined alignment and indexing said wheel a predetermined portion of one revolution thereof.

15. A programmable timing device comprising:

(a) a support member (b) a circular timing dial mounted for rotational motion on said support member having a plurality of spaced openings about the outer periphery of said dial;

(c) means for rotating said dial;

(d) first timing element removably positioned in a preselected one of said openings;

(e) a second timing element removably positioned in a preselected another of said openings;

(f) an actuating wheel member rotatably mounted on said support member adjacent said dial, said wheel member having a plurality of projections located in positions such that said first and second elements sequentially contact said projections and cause said wheel member to be indexed a portion of one revolution thereof;

(g) electrical means operatively connected to said wheel member for changing the electrical state of a remote-controlled device in response to the indexing of said wheel member, and (h) skip cycle means, responsive to movement of said dial when in a predetermined orientation, for moving said actuating wheel member from a first position to a second position and displacing said projections out of contact with said elements.

16. The device of claim 15 including means for biasing said wheel into said first position.

17. The device of claim 16 in which said first element has a tab and said skip cycle means comprises a skip wheel rotatably mounted on said support member adjacent to said dial and actuating wheel, said skip wheel having a plurality of spaced arms projecting therefrom, said tab contacting in sequential order said spaced arms and indexing said wheel portion of a revolution thereof as said dial rotates said tab thereby.

18. The device of claim 17 in which said skip cycle means further comprises a cam surface member selectively removably positioned on said skip wheel, said cad surface contacting said actuating wheel when said skip wheel is indexed into a predetermined alignment with said actuating wheel and moving said actuating wheel into said second position.

19. Timer apparatus comprising:

a dial;

means for rotating said dial about an axis, each revolution of aid dial corresponding to a predetermined time period;

an actuator wheel, disposed in proximity to said dial for rotation about, and translating along, an axis generally parallel to the axis of said dial;

said actuator wheel including at least a plurality of projections disposed at a predetermined position around said wheel;

means for biasing said actuator wheel into a first predetermined position;

a plurality of indexing elements, cooperating with said dial, including a first extension disposed to interact with said actuator wheel's first set of projections when said actuator wheel is in said first predetermined position, to rotationally index said actuator wheel when said indexing elements are brought into conjunction with said actuator wheel by rotation of said dial;

means, responsive to the rotational position of said actuator wheel, for controllably changing the electrical state thereof;

means for selectively translating said actuator wheel to a second position such that said projections are removed from interaction with said elements.

20. The timer apparatus of claim 19 including a skip wheel disposed in proximity to said dial and said actuator wheel for rotation about an axis generally parallel to the axis of said dial, a plurality of portions thereof disposed for successive interactions with one of said indexing elements as said elements are rotated in proximity thereto and indexing said wheel, and at least one skip element associated with said skip wheel disposed to interact with said actuator wheel when said element is brought into conjunction with said actuator wheel and causing said actuator wheel to translate along its axis to said second position.

* * * * *